US008002205B2

(12) United States Patent
Lambert et al.

(10) Patent No.: US 8,002,205 B2
(45) Date of Patent: Aug. 23, 2011

(54) INJECTION NOZZLE

(75) Inventors: Malcolm Lambert, Gillingham (GB); Andrew Limmer, Sudbury (GB); Mark Norman, Sudbury (GB); Michael Mcloone, Sudbury (GB)

(73) Assignee: Delphi Technologies Holding S.arl

( * ) Notice: Subject to any disclaimer, the term of this patent is extended or adjusted under 35 U.S.C. 154(b) by 486 days.

(21) Appl. No.: 10/575,052

(22) PCT Filed: Oct. 6, 2004

(86) PCT No.: PCT/GB2004/004245

§ 371 (c)(1),
(2), (4) Date: Apr. 2, 2007

(87) PCT Pub. No.: WO2005/035973

PCT Pub. Date: Apr. 21, 2005

(65) Prior Publication Data

US 2007/0272772 A1 Nov. 29, 2007

(30) Foreign Application Priority Data

Oct. 6, 2003 (EP) ..... 03256280

(51) Int. Cl.

| | |
|---|---|
| ***F02M 59/00*** | (2006.01) |
| ***F02M 61/00*** | (2006.01) |
| ***F02M 63/00*** | (2006.01) |
| ***F02M 61/10*** | (2006.01) |

(52) U.S. Cl. ..... 239/533.2; 239/533.11; 239/533.12; 123/446; 123/467

(58) Field of Classification Search .. 239/533.3–533.12; 123/299, 446, 447, 467, 468
See application file for complete search history.

(56) References Cited

U.S. PATENT DOCUMENTS

| | | | | |
|---|---|---|---|---|
| 1,952,816 | A * | 3/1934 | Mock | 239/488 |
| 4,153,205 | A * | 5/1979 | Parrish, Jr. | 239/533.9 |
| 4,470,548 | A * | 9/1984 | Ushimura | 239/533.3 |
| 5,890,660 | A * | 4/1999 | Stevens | 239/533.3 |
| 6,427,932 | B1 * | 8/2002 | Danckert et al. | 239/533.12 |
| 6,565,017 | B1 * | 5/2003 | Fath et al. | 239/533.3 |
| 6,669,117 | B2 * | 12/2003 | Boecking | 239/533.3 |
| 6,892,965 | B2 * | 5/2005 | Haeberer et al. | 239/533.12 |
| 7,404,526 | B2 * | 7/2008 | Cooke et al. | 239/533.11 |

FOREIGN PATENT DOCUMENTS

| | | |
|---|---|---|
| DE | 10000501 | 7/2001 |
| DE | 10122503 | 11/2002 |
| JP | 297656 B | 4/1952 |
| JP | 2002535537 T | 7/2000 |
| JP | 2001221135 A | 8/2001 |
| WO | 0201065 | 3/2002 |
| WO | 0236961 | 10/2002 |

* cited by examiner

*Primary Examiner* — Dinh Q Nguyen
*Assistant Examiner* — Justin Jonaitis
(74) *Attorney, Agent, or Firm* — Thomas N. Twomey

(57) ABSTRACT

An injection nozzle for an internal combustion engine has a valve member (10) with a seating line (112) defining a seat diameter, the seating line (112) being engageable with a seating surface (14) to control fuel injection by the nozzle, in use. The seating line is defined by an annular ridge (40, 44, 46), integrally formed with the valve needle (10), so as to reduce variations in the seat diameter which would otherwise arise at manufacture due to contact between the valve needle (10) and the seating surface (14) in regions other than at the seating line. The invention provides an advantage in manufacture as repeatability and consistency of the geometry, and in particular the effective seat diameter, of nozzle products is improved.

11 Claims, 3 Drawing Sheets

INJECTION NOZZLE

Figure 1:
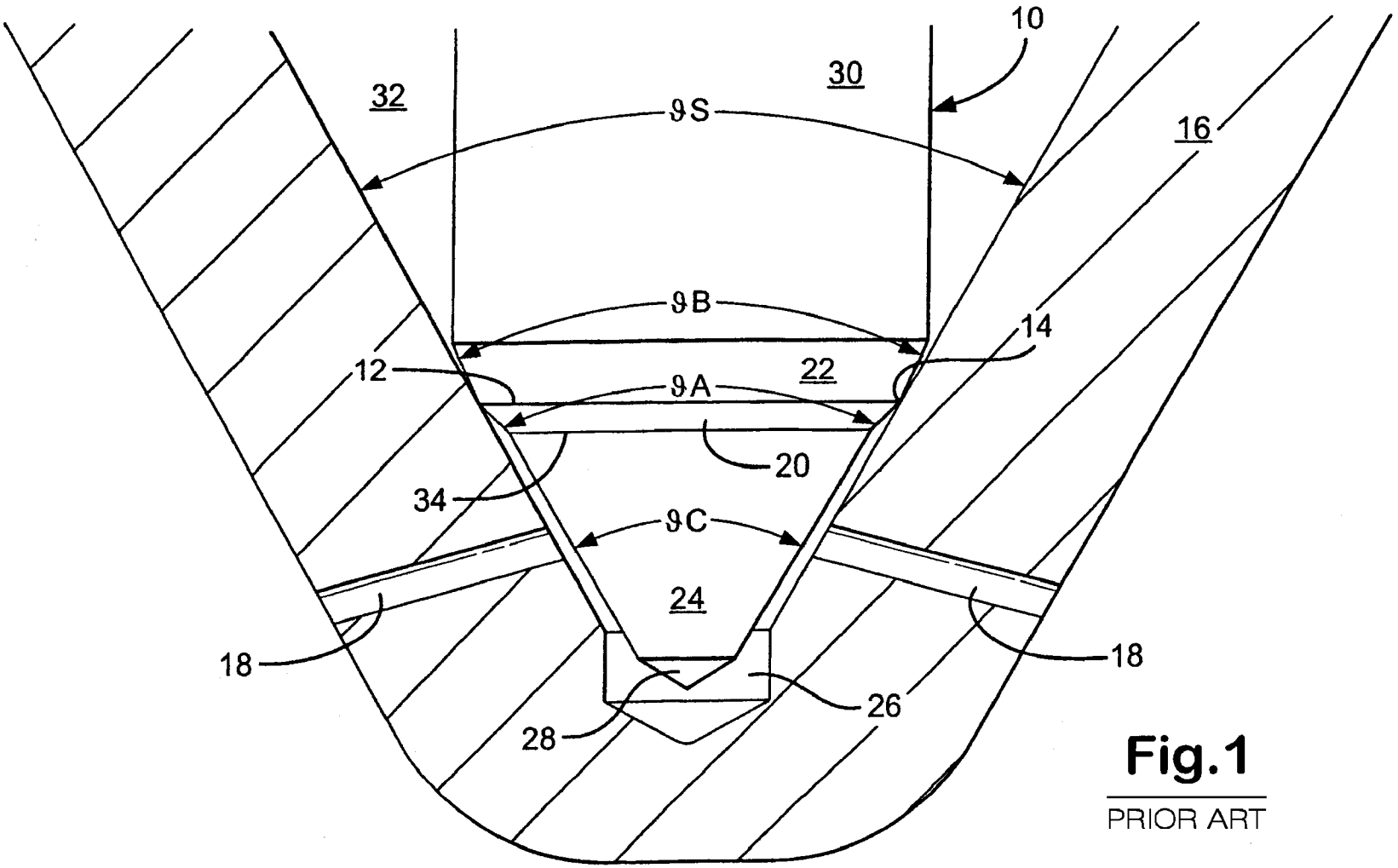
Fig.1 PRIOR ART

The invention relates to an injection nozzle for use in a fuel injection system for an internal combustion engine. In particular, but not exclusively, the invention relates to an injection nozzle for use in a compression ignition internal combustion engine, in which a valve needle is engageable with a seating surface to control the injection of fuel to an associated combustion space through a nozzle outlet.

The valve needle in known injection nozzle designs includes a region of conical form which is shaped to engage with a corresponding generally conical seating surface. The valve needle is slideable within a bore provided in an injection nozzle body and an internal surface of the bore defines the seating surface for the needle. When the valve needle is seated against the seating surface fuel injection is prevented and when the valve needle is lifted away from the seating surface fuel injection occurs.

The valve needle is shaped to define an annular seating line which engages with the seating surface. It has long been recognized that the effective diameter of the seating line (referred to as 'the effective seat diameter') varies with wear during nozzle service life. The effective seat diameter is determined by the diameter of the line of contact between the valve needle and the seating surface. This is an important parameter of injection nozzle design as it influences fuel delivery pressure, or nozzle opening pressure (i.e. that pressure at which the valve needle is caused to lift from its seat), and thus affects the quantity of fuel that is delivered during injection (i.e. when the valve needle is lifted). Variation in the effective seat diameter as the valve needle and/or its seat wears, in use, is therefore undesirable and it is often a focus of injection nozzle design to shape the valve needle and/or the seat so as to ensure such wear is minimized. In this way variations in the effective diameter of the seating line throughout the nozzle service life can be reduced.

Several nozzle designs have been proposed to address this problem (see the Applicant's co-pending European patent applications EP 1079095 A and EP 04254231.6. It is a feature of some of these nozzles that the valve needle and the seating surface are shaped so that respective cones angles define a very small differential angle immediately upstream and/or immediately downstream of the valve needle seating line. In some cases the differential angles are offset radially from the seating surface, but in the preferred designs this offset is often set to a minimum.

It has now been recognized that variations in the effective seat diameter arise at the point of manufacture due to the limit of accuracy with which the seating surface defined by the nozzle body bore can be formed. In practice, any straightness or form error in the seating surface can cause local contact between the valve needle and the seating surface in regions displaced from the geometric seat (i.e. the seat as dictated by the designed geometry of the nozzle). This is a particular problem in injection nozzles having a particularly small differential angle upstream or downstream of the seating line, and particularly where the radial offset is very small or non existent. An incompatibility therefore exists between the desire for wear variations in the effective seat diameter to be minimized, and consistent and accurate manufacture of nozzle geometry.

It is one object of the present invention to provide an improved injection nozzle design which addresses this incompatibility.

In accordance with a first aspect of the present invention, there is provided an injection nozzle for an internal combustion engine, comprising a valve member having a seating line defining an effective seat diameter, the seating line being engageable with a seating surface to control fuel injection by the nozzle, in use, and characterized in that the seating line is defined by a protruding or raised annular ridge on the valve needle, which serves to reduce variations in the effective seat diameter which would otherwise occur at manufacture.

The present invention provides the valve needle with a ridge or collar, which stands proud of the remainder of the valve needle surface, to define the valve needle seating line. Hence, any straightness or form error in the seating surface is less likely to result in local contact between the valve needle and the seating surface, in regions other than at the geometric seating line on the ridge.

The injection nozzle of the present invention may take many different forms, but it is particularly appropriate to designs in which a small differential angle (i.e. the difference in cone angle between the valve needle and the seating surface) is defined immediately upstream and/or immediately downstream of the geometric seating line.

In one embodiment, the annular ridge may include an upstream ridge region and a downstream ridge region, the seating line being defined at an intersection between said upstream and downstream ridge regions.

The seating surface defines a seat cone angle. The upstream ridge region is preferably immediately downstream of, or forms an integral part of, an upstream seat region of frusto-conical form. The upstream seat region defines an upstream cone angle, and the upstream cone angle and the seat cone angle together define a first differential angle between them.

The downstream ridge region is preferably immediately upstream of, or forms an integral part of, a downstream seat region of frusto-conical form. The downstream seat region defines a downstream cone angle, and the downstream cone angle and the seat cone angle together define a second differential angle between them.

In one embodiment the first differential angle is smaller than the second differential angle. Alternatively, the first differential angle may be greater than the second differential angle. In another embodiment, the first and second differential angles are selected so as to be substantially equal to one another.

In any event, the first and second differential angles are selected so that wear of the valve needle, in use, tends not to alter the effective seat diameter. For example, this may be achieved by forming the upstream seat region and the downstream seat region so as to define a slightly larger differential angle upstream of the seating line (the first differential angle) than that defined downstream of the seating line (the second differential angle). As wear tends to occur equally in both upstream and downstream directions, the seating line remains at approximately the same location on the valve needle axis and, hence, fuel delivery drift is minimized.

In one particular embodiment the valve needle includes a circumferential groove arranged downstream of the downstream ridge region and immediately upstream of a further region, for example a valve tip region, wherein a lower edge of the circumferential groove and the further region define an intersection which defines, together with the seating surface, a radial clearance that is sufficiently small so that a lower portion of the downstream ridge region defines a load bearing surface for the valve needle.

Preferably, the annular ridge or collar is shaped so that a region of the valve needle adjacent to the ridge on the upstream side of the seating line (for example the upstream seat region) defines, together with the seating surface, a radial clearance of no more than 10 μm, and preferably in a range of between 0.5 and 5 μm. More preferably, the annular ridge is also shaped so that a region of the valve needle adjacent to the ridge on the downstream side of the seating line (for example the valve tip region) defines, together with the seating surface, a radial clearance of no more than 10 μm, and preferably in a range of between 0.5 and 5 μm.

A valve tip region may be arranged immediately downstream of the downstream ridge region, and this valve tip region may be provided with a chamfered tip. If a circumferential groove is provided, the valve tip region may be arranged immediately downstream of this.

In any of the embodiments, the downstream ridge region may be a separate part from the downstream seat region, or may be integrally formed with the downstream seat region.

It will be appreciated that the injection nozzle may take the form of a VCO-type nozzle or a sac-type nozzle.

Figures 2A, 2B:
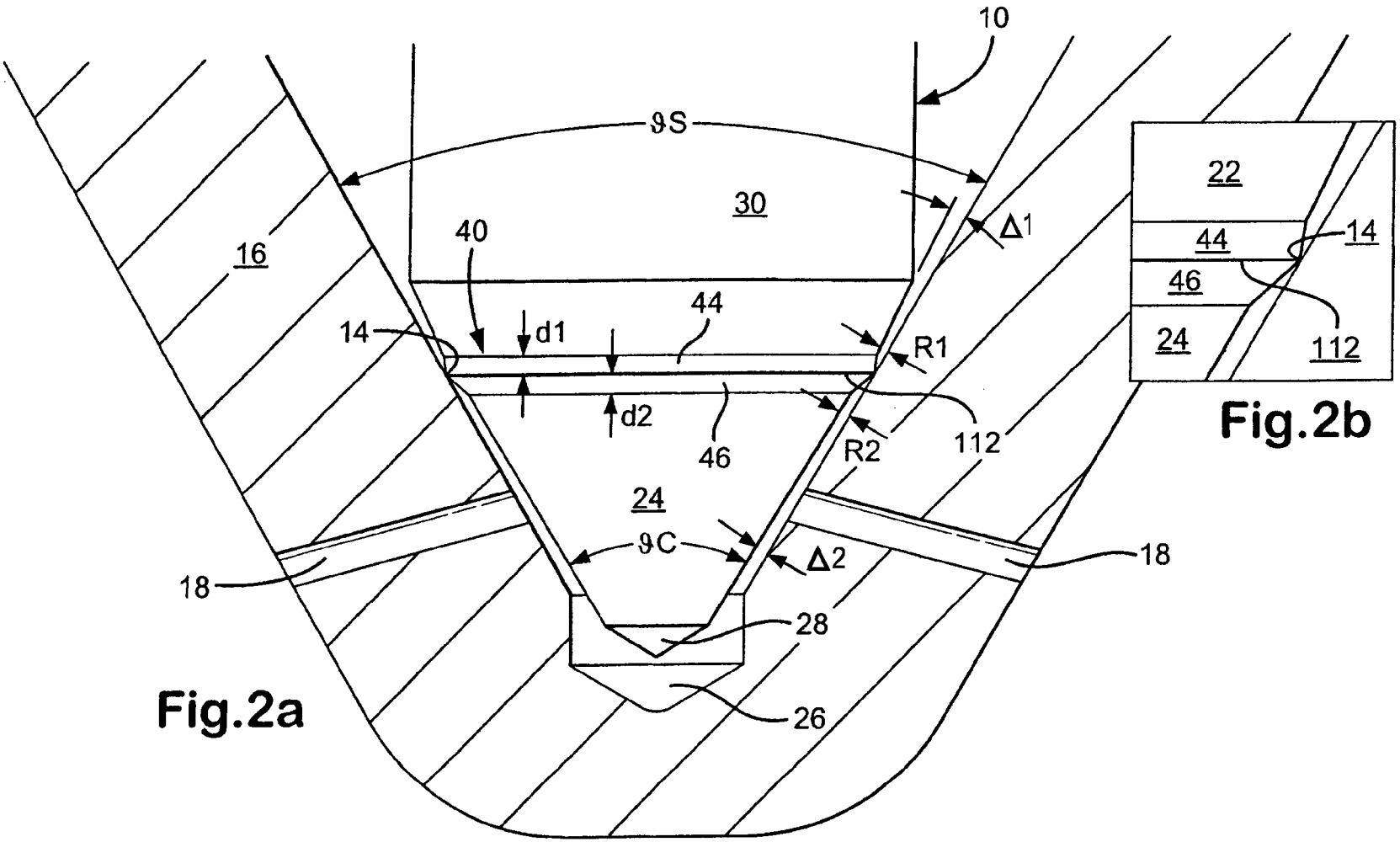
Figures 3A, 3B:
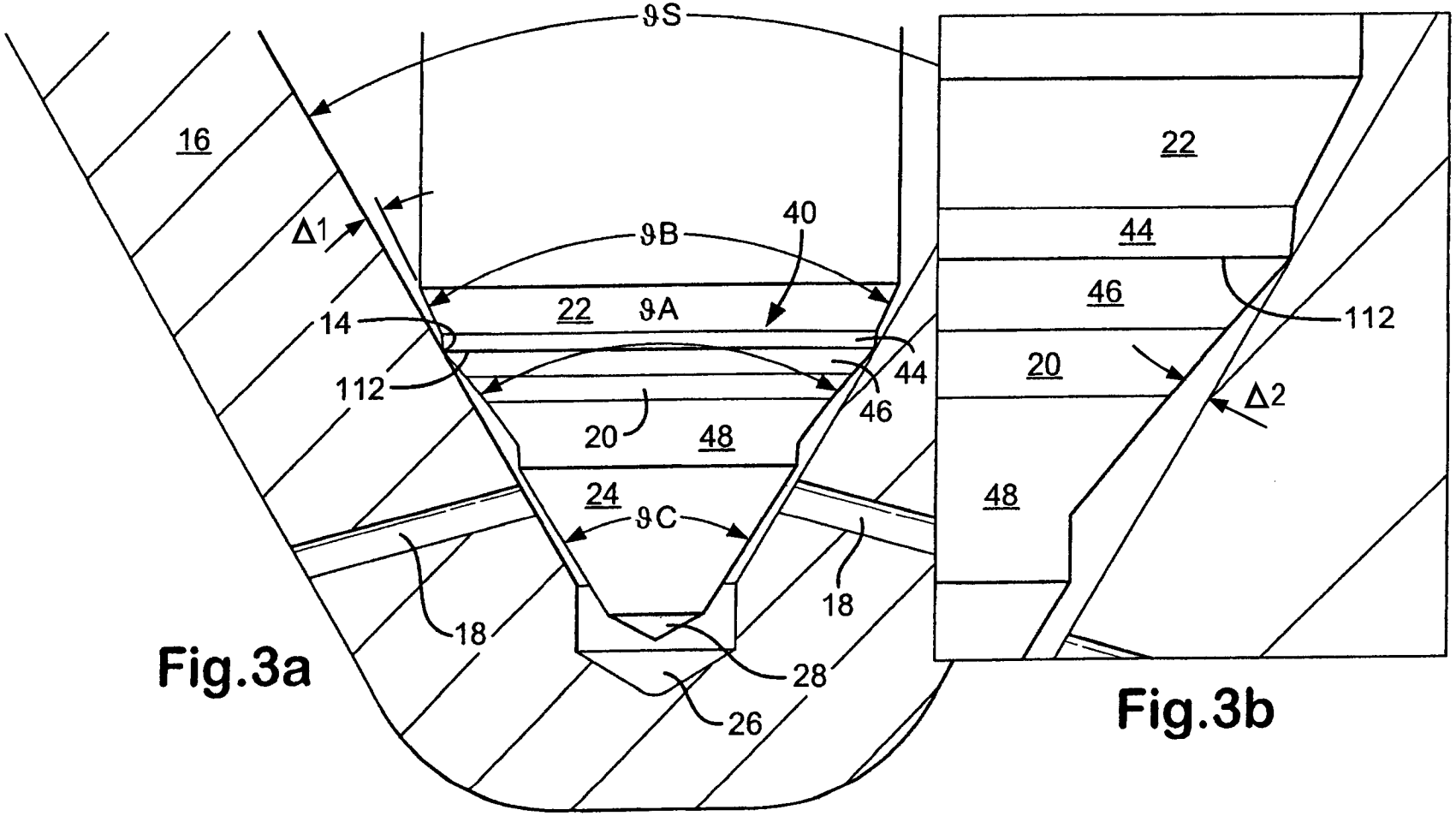

The invention will now be described, by way of example only, with reference to the accompanying drawings in which:

FIG. 1 is a schematic drawing of an injection nozzle which may be modified in accordance with the present invention, FIG. 2*a* is a schematic drawing of one embodiment of the injection nozzle of the present invention and FIG. 2*b* is an enlarged view of a region of a valve needle of the injection nozzle in FIG. 2*a*, FIG. 3*a* is a schematic drawing of another injection nozzle which may be modified in accordance with the present invention and FIG. 3*b* is an enlarged view of the valve needle of the injection nozzle in FIG. 3*a* in the region of the seating line.

The injection nozzle shown in FIG. 1 is described in our co-pending European patent application 04254231.6. The nozzle will be described in detail here so as to fully explain the further benefits of the present invention, even though this nozzle does not include all of the essentials feature of the present invention.

The injection nozzle of FIG. 1 includes a valve member, or valve needle (referred to generally as 10) having an annular seatable surface 12, or seating "line", which engages with a seating surface 14 defined by an internal surface of a bore provided in a nozzle body 16. In use, the valve needle 10 is caused to move within the bore and, as it moves away from the seating surface 14, injection nozzle outlets 18 are opened to enable high pressure fuel to be injected to the associated engine cylinder. When the valve needle 10 is moved to re-engage with the seating surface 14, the outlets 18 are closed and injection is terminated.

The valve needle 10 is typically movable by means of an injection control valve arrangement (not shown). The control valve arrangement may be of the type actuated by means of a piezoelectric actuator in a manner which would be familiar to a person skilled in the art. Alternatively the valve needle 10 may be movable by electromagnetic means.

The bore in the nozzle body 16 is of conical form so that the seating surface 14 defines a seat cone angle, ϑS. The valve needle 10 is shaped to include four distinct regions. A first region 20 of frusto-conical form defines a first (downstream) cone angle, ϑA. Immediately upstream of the first region 20, the valve needle includes a second region 22, also of frusto-conical form, which defines an upstream cone angle, ϑB. Immediately downstream of the first region 20, the valve needle includes a third region 24, in the form of a valve tip region. The valve tip region is also of frusto-conical form and defining a downstream cone angle, ϑC. The valve tip 24 extends into a sac volume 26 or chamber defined at a blind end of the bore and terminates in a chamfered tip 28. A fourth, substantially cylindrical region 30 is provided at the upper end of the valve needle 10 (in the illustration shown).

The first region 20 of the valve needle 10 may be referred to as a downstream seat region and the second region 22 of the valve needle 10 may be referred to as an upstream seat region. The downstream and upstream seat regions 20, 22 together define an annular line of intersection between them, which forms the seating line 12 of the valve needle 10. In use, an upstream supply chamber 32 is supplied with high pressure fuel for injection. When it is required to inject fuel into the engine cylinder the valve needle 10 is actuated or otherwise caused to lift so that the seating line 12 moves away from its seating surface 14. The dimensions of the upstream and downstream seat regions 22, 20 and their respective cone angles, ϑB, ϑA, are selected so as to optimize wear of the valve needle 10, depending on the particular requirements of the application. For example, by selecting the upstream differential angle (i.e. defined between ϑB and ϑS) to be relatively small, typically between 0.5 and 5 degrees and by selecting the downstream differential angle (i.e. between ϑA and ϑS) to be slightly larger, the seating line 12 tends to migrate to increase the 'effective' seat diameter (he effective diameter is intended to mean to diameter of the line of contact between the valve needle and the seating surface). As a result fuel delivery quantity for an injection event will tend to decrease, and this can be beneficial in some applications.

Alternatively, the upstream and downstream differential angles may be selected so as to ensure wear of the valve needle occurs in approximately equal amounts on upstream and downstream sides of the seating line 12, thereby substantially eliminating delivery drift altogether. This may be achieved, for example, by selecting the upstream differential angle to be slightly greater than the downstream differential angle, providing that both differential angles are relatively small.

It has now been recognized that a problem may arise during manufacture and assembly of injection nozzles such as those shown in FIG. 1. The problem arises in defining the seat diameter of the seating line 12 (referred to as the 'geometric seating line'), as the limits of the machining processes which are commonly used result in the straightness and form of the seating surface 14 deviating from the geometric ideal in some circumstances. With very small differential angles between the valve needle 10 and the seating surface 14 (i.e. between the upstream seat region 22 and the seating surface 14, and between the downstream seat region 20 and the seating surface 14), any deviation in the form of the seating surface 14 can cause local contact between the needle 10 and the seating surface 14 in regions other than at the geometric seating line. This causes the effective seating diameter to may vary from product to product when the nozzle is new. In FIG. 1, for example, this is a particular problem on the upstream side of the seating line 12 where the upstream seat region 22 defines a relatively small differential angle with the seat cone angle ϑS with no radial offset between the region seat 22 and the seating surface 14.

FIG. 2*a* shows a first embodiment of the present invention, and FIG. 2*b* shows an enlarged view of an important part of the needle in FIG. 1, which overcomes the aforementioned disadvantage. Where possible, similar parts to those shown in FIG. 1 have been identified with like reference numerals and are not described in further detail.

The valve needle 10 of FIGS. 2*a* and 2*b* is identical to the needle in FIG. 1, except that it includes an integral annular ridge or collar, referred to generally as 40. The ridge 40 forms a raised or protruding region, which stands proud of the remainder of the surface of the valve needle and lies immediately downstream of the upstream seat region 22. The ridge 40 therefore defines a seating line 112 of the valve needle, which is engageable with the seating surface 14.

Referring also to FIG. 2*b*, the ridge 40 includes an upstream ridge region 44, having an axial length d1, and a downstream ridge region 46, having an axial length d2. The lower edge (in the orientation shown) of the upstream ridge region 44 defines, together with an upper edge of the downstream ridge region 46, the valve needle's seating line 112. By comparing FIGS. 2*a* and 2*b* with FIG. 1 it can be seen that, essentially, the downstream ridge region 46 (FIGS. 2*a* and 2*b*) is equivalent to the downstream seat region 20 (FIG. 1). The downstream ridge region 46 tapers downstream from a protruding upper edge at the seating line 112 to a downstream edge that is flush with the valve tip 24. The upstream ridge region 44 is an additional formation on the valve needle 10, compared to that in FIG. 1, and tapers in an upstream direction from a protruding lower edge (at the seating line 112) to an upstream edge that is flush with, or blends into, the upstream seat region 22.

Typically, the axial length d1 is no greater than 0.1 mm, and preferably less than 0.05 mm. The axial length d2 is of similar dimension. A radial clearance R1 is defined between the upstream seat region 22 (just above the upstream ridge region 44) and the seating surface 14 and a radial clearance R2 is defined between the valve tip region 24 (just below the downstream ridge region 46) and the seating surface 14. The ridge 40 is preferably shaped to protrude from the valve needle surface such that R1 and R2 are no greater than 10 μm, and preferably are between 0.5 and 5 μm.

By introducing an annular ridge 40 on the valve needle 10, the risk of any deviation in straightness or form in the seating surface 14, which may otherwise cause unwanted local contact between the surface 14 and the valve needle 10, is reduced. This is due to the seating line 112 being formed on the ridge or protruding portion 40 of the valve needle surface. The risk of local contact is particularly great where there is no radial offset between either the upstream seat region 22 and the seating surface 14 (i.e. as in FIG. 1) or between the downstream seat region 20 and the seating surface 14. Therefore, referring to the valve needle 10 in FIGS. 2*a* and 2*b* and comparing this with the valve needle in FIG. 1, a particular advantage is provided on the upstream side of the seating line 112.

The present invention provides a manufacturing advantage over previously proposed injection nozzle designs as the accuracy with which the geometric seating line 112 of the valve needle 10 can be reproduced is improved. Product to product consistency is therefore improved at manufacture.

The annular ridge 40 provided on the nozzle design in FIGS. 2*a* and 2*b* may also be incorporated on other nozzle designs to provide the same advantage. For example, FIGS. 3*a* and 3*b* shows an alternative nozzle configuration which may also be provided with an annular ridge such as that in FIGS. 2*a* and 2*b*. Where possible, similar parts to those shown in FIGS. 2*a* and 2*b* are identified with like reference numerals.

In FIGS. 3*a* and 3*b*, the annular ridge 40 defines the seating line 112 and is defined at the intersection between an upstream ridge region 44 and a downstream ridge region 46. The downstream ridge region 46 is adjacent to and/or forms part of the downstream seat region 20 and the upstream ridge region 44 is adjacent to and/or forms part of the upstream seat region 22. In the particular illustration shown, the downstream ridge region 46 tapers downstream from a protruding upper edge at the seating line 112 to a lower edge that is flush with the downstream seat region 20. One difference between the embodiment in FIG. 2 and that in FIG. 3 is that, in FIG. 3, the downstream ridge region 46 and the downstream seat region 20 are identified as separate regions, whereas in FIG. 2 the downstream ridge region 46 effectively takes the place of the downstream seat region 20. In FIG. 3, the downstream ridge region 46 therefore forms an additional feature on the valve needle 10.

The upstream ridge region 44 also forms an additional feature of the valve needle 10, and tapers in an upstream direction from a protruding lower edge at the seating line 112 to an upper edge that is flush with the upstream seat region 22. In FIG. 3, the dimensions of the upstream and downstream ridge regions 44, 46 may be similar to those in the FIG. 2 embodiment.

The upstream and downstream seat regions 22, 20 of the valve needle 10 are shaped so that wear of the needle 10 occurs in both downstream and upstream directions relative to the seating line 112 in approximately equal amounts. This is achieved by selecting a relatively small upstream differential angle Δ1 between the upstream seat region 22 and the seat cone angle, ϑS, and by selecting a relatively small downstream differential angle Δ2 between the downstream seat region 20 and the seat cone angle, ϑS, and where the differential angle Δ2 on the downstream side is slightly smaller than the differential angle Δ1 on the upstream side. Typically, for example, the upstream and downstream seat regions 22, 20 may be shaped so as to define a differential angle Δ1 Δ2 with the nozzle body seat angle, ϑS, of between about 0 degrees 10 minutes and 5 degrees.

The valve needle 10 is also provided, as an optional feature, with a circumferential groove 48 immediately downstream of the downstream seat region 20 (i.e. just below the lower ridge region) and immediately upstream of the valve tip region 24. These two regions 20, 48 define an intersection between them which defines a relatively small radial clearance with the seating surface so as to ensure the downstream seat region 20 and the downstream ridge region 46 define a load bearing surface for the needle 10, in use.

When the injection nozzle of FIG. 3 is used initially, the effective seating diameter is defined by the surface or line 112 of intersection between the upstream ridge region 44 and the downstream ridge region 46. As the injection nozzle components wear, in use, contact pressure between the valve needle 10 and the seating surface 14 tends to distribute approximately equally over both the upstream and downstream seat regions 22, 20, although the primary line of contact remains at approximately the same axial position (i.e. that of the original geometric seating line 112). As a result, the effective seating diameter changes very little with wear, and hence the fuel delivery quantity and nozzle opening pressure also varies only a little, or hardly at all.

The invention provides a particular advantage when incorporated on this nozzle configuration in circumstances in which there is no radial offset between the valve needle 10 and the seating surface 14, either upstream or downstream of the seating line 112, as in such designs the risk of surface to surface contact between the valve needle 10 and the surface 14, other than at the geometric seating line, is otherwise increased.

In a further alternative embodiment (not shown but similar to FIG. 3*a*) the circumferential groove may be replaced with an additional frusto-conical region, immediately below the downstream seat region 20 (and hence the downstream ridge region), which defines a slightly reduced differential angle with the seat cone angle, ϑS, to that defined by the downstream seat region 20 and the seat cone angle, ϑS. The provision of this additional region also ensures the downstream ridge region 46 and the downstream seat region 20 define a load bearing surface for the needle, to reduce wear and to limit the extent of variation of the effective seat diameter, in use.

Other examples of nozzle designs which may also be provided with an annular collar or ridge to define the valve needle seating line 112 can be found in our co-pending European patent applications EP 04254231.6 and EP 1079095 A.

It will be appreciated that the differential angles (i.e. the difference in cone angle between respective surfaces of the valve needle and its seat) and other dimensions stated in the previous description are given by way of illustrative example only, and that values falling outside of the specified ranges may also be implemented to provide substantially the same technical advantages of the invention, as set out in the accompanying claims.

The injection nozzles shown in the accompanying drawings are what is commonly referred to as VCO-type nozzles (valve covered orifice type), in which the valve needle 10 covers the inlet end of the or each nozzle outlet 18 when it is seated (i.e. when no injection takes place). The invention is equally applicable, however, to injections nozzles of the sac type in which the inlet end of each nozzle outlet is in constant communication with the sac chamber at the blind end of the nozzle body bore, and unseating and seating of the valve needle serves to control the flow of fuel into the sac chamber and, hence, through the nozzle outlets.

The invention claimed is:

1. An injection nozzle for an internal combustion engine, the injection nozzle comprising;

a nozzle body (16) provided with a bore defining a valve seating surface (14) having a seat cone angle ($\vartheta$S);

a valve member (10) which is moveable within the bore, wherein the valve member (10) includes an upstream seat region (22) defining an upstream cone angle ($\vartheta$B), the upstream cone angle ($\vartheta$B) and the seat cone angle ($\vartheta$S) together defining an upstream differential angle ($\Delta$l) between them, and a downstream seat region (20, 24) defining a downstream cone angle ($\vartheta$A), the downstream cone angle ($\vartheta$A) and the seat cone angle ($\vartheta$S) together defining a downstream differential angle ($\Delta$2) between them, the valve member (10) further comprising an annular ridge (40) that includes an upstream ridge region (44) protruding from the surface of the upstream seat region (22) and an adjacent downstream ridge region (46) protruding from the surface of the downstream seat region (20, 24), said annular ridge (40) disposed immediately downstream of the upstream seat region (22), said protruding annular ridge (40) defining an annular seating line (112) at the intersection of the upstream and downstream ridge regions (44,46), said seating line (112) having a seat diameter, the seating line (112) being engageable with the valve seating surface (14) to control fuel injection from the nozzle body (16).

2. The injection nozzle as claimed in claim 1, wherein the valve member (10) includes a circumferential groove (48) arranged downstream of the downstream ridge region (46) and immediately upstream of a further region (24), wherein a lower edge of the circumferential groove and the further region (24) define an intersection which defines, together with the seating surface (14), a radial clearance that is sufficiently small so that a lower portion of the downstream ridge region (46) defines a load bearing surface for the valve member (10).

3. The injection nozzle as claimed in claim 1, wherein the upstream ridge region (44) is immediately downstream of, or forms an integral part of, the upstream seat region (22) and wherein the downstream ridge region (46) is immediately upstream of, or forms an integral part of, the downstream seat region (20).

4. The injection nozzle as claimed in claim 1, wherein the upstream differential angle ($\Delta$1) is smaller than the downstream differential angle ($\Delta$2).

5. The injection nozzle as claimed in claim 1, wherein the upstream differential angle ($\Delta$l) is greater than the downstream differential angle ($\Delta$2).

6. The injection nozzle as claimed in claim 1, wherein the upstream differential angle ($\Delta$l) is selected to be substantially the same as the downstream differential angle ($\Delta$2) so that, regardless of wear of the seating line (112), in use, the seat diameter maintains a substantially constant value.

7. The injection nozzle as claimed in claim 1, wherein the protruding annular ridge (40) is shaped so that the upstream region (22) defines, together with the seating surface (14), a radial clearance of no more than 10 μm.

8. The injection nozzle as claimed in claim 1, wherein the protruding annular ridge (40) is shaped so that a region (24) of the valve member (10) adjacent thereto on a downstream side of the seating line (112) defines, together with the seating surface (14), a radial clearance of no more than 10 μm.

9. The injection nozzle as claimed in claim 8, wherein the region adjacent to the protruding annular ridge (40) on the downstream side of the seating line (112) is a valve tip region (24).

10. The injection nozzle as claimed in claim 9, wherein the valve tip region (24) includes a chamfered tip (28).

11. The injector nozzle as claimed in claim 1, being one of (i) VCO-type or (ii)sac-type.

* * * * *